US008046948B2

(12) United States Patent
Mauch et al.

(10) Patent No.: US 8,046,948 B2
(45) Date of Patent: Nov. 1, 2011

(54) RETROFIT SAFETY MEANS FOR WEAPONS AND METHOD FOR SECURING WEAPONS

(75) Inventors: Ernst Mauch, Dunningen (DE); Dirk Steuwer, München (DE)

(73) Assignee: Armatix GmbH, Unterfohring (DE)

( * ) Notice: Subject to any disclaimer, the term of this patent is extended or adjusted under 35 U.S.C. 154(b) by 279 days.

(21) Appl. No.: 11/974,932

(22) Filed: Oct. 16, 2007

(65) Prior Publication Data

US 2009/0007476 A1 Jan. 8, 2009

(30) Foreign Application Priority Data

Oct. 20, 2006 (EP) ..... 06022066

(51) Int. Cl.
*F41A 17/00* (2006.01)

(52) U.S. Cl. ..... 42/70.01; 42/70.08

(58) Field of Classification Search ..... 42/70.01, 42/70.08

See application file for complete search history.

(56) References Cited

U.S. PATENT DOCUMENTS

| | | | | |
|---|---|---|---|---|
| 4,488,370 | A * | 12/1984 | Lemelson | 42/70.01 |
| 4,833,970 | A * | 5/1989 | Wilhelm | 89/141 |
| 5,467,550 | A * | 11/1995 | Mumbleau | 42/70.11 |
| 6,343,140 | B1 * | 1/2002 | Brooks | 382/115 |
| 6,412,207 | B1 * | 7/2002 | Crye et al. | 42/70.06 |
| 6,563,940 | B2 * | 5/2003 | Recce | 382/120 |
| 6,631,579 | B1 * | 10/2003 | Lauster et al. | 42/70.11 |
| 6,817,130 | B2 * | 11/2004 | Ivanov | 42/70.06 |
| 6,941,692 | B1 * | 9/2005 | Krinke et al. | 42/70.08 |
| 2002/0170220 | A1 * | 11/2002 | Recce | 42/70.08 |
| 2003/0097776 | A1 * | 5/2003 | Brosow | 42/70.01 |
| 2005/0011100 | A1 * | 1/2005 | Fluhr | 42/70.08 |
| 2006/0117632 | A1 * | 6/2006 | Meyerle | 42/70.01 |
| 2006/0277808 | A1 * | 12/2006 | Danner et al. | 42/70.09 |

FOREIGN PATENT DOCUMENTS

| | | |
|---|---|---|
| EP | 1048919 | 11/2000 |
| FR | 2480928 | 2/1981 |
| WO | WO 2005/054771 | 6/2005 |
| WO | WO 2005/079288 | 9/2005 |
| WO | WO 2005/116567 | 12/2005 |

OTHER PUBLICATIONS

European Search Report for 06022066.2-1260, Apr. 16, 2007; 11 pages.

* cited by examiner

*Primary Examiner* — Michael Carone
*Assistant Examiner* — Samir Abdosh
(74) *Attorney, Agent, or Firm* — Westman, Champlin & Kelly, P.A.

(57) ABSTRACT

The present invention relates to a safety means for weapons. The safety means comprises an electronic control unit for the authentication of an authorized user and the control of a safety mechanism. The safety mechanism mechanically engages with at least one mechanical part of the ignition chain so that said ignition chain is interrupted and firing is prevented. The safety mechanism comprises an actuator for releasing said engagement of the safety mechanism in case the electronic control unit identifies an authentication signal. The safety means according to the present invention is provided in a retrofit main component part of a weapon, which replaces a corresponding original main component part of the weapon. The safety means is preferably controllable by a transponder.

23 Claims, 7 Drawing Sheets

RETROFIT SAFETY MEANS FOR WEAPONS AND METHOD FOR SECURING WEAPONS

This application claims priority to European Patent Office Application No. 06022066.2, filed Oct. 20, 2006.

The present invention generally relates to a retrofit safety means for preventing firing of the weapon by an unauthorized user. In particular, the present invention provides an electromechanical safety mechanism in a retrofit main component part of a weapon which replaces a corresponding original main component part of the weapon. The safety means is preferably controllable by a transmitter, responder and/or a transponder.

Weapons are used in various fields, e.g., in the police service, the security service, the military service, in riflemen's associations, hunters associations and in the private field. Most of the use or available weapons allow authorized and unauthorized users to fire the weapon by simply releasing an accidental firing safety of the weapon. Thus for a huge amount of weapons it is not possible to prevent firing of the weapon by unauthorized users.

Various safety mechanisms have been developed for i) preventing accidental firing of the weapon and for ii) preventing firing of the weapon by an unauthorized user.

With regard to item i), a typical mechanism for preventing accidental firing is incorporated into the trigger in the form of a lever (trigger safety mechanism). In the untouched state the trigger safety mechanism blocks the trigger from being moved backward. If the weapon is dropped or if the trigger is subjected to an off-center, lateral pressure, it is still impossible for the gun to fire. Thus, the trigger safety mechanism ensures that a weapon can only be discharged by the trigger being pulled by the trigger finger. Another example for preventing accidental firing is a firing pin safety mechanism which prevents the firing pin from moving forward to act on the primer of the cartridge. In the secured position, a spring-loaded safety pin projects into a firing pin cut-out and blocks the firing pin. As the trigger is pulled backwardly or towards the rear, an extension on the trigger bar pushes the spring-loaded safety pin up and opens the firing pin channel. Again, this safety mechanism can only be released by the trigger being pulled backwardly. Still another example for preventing accidental firing is a drop safety mechanism. In the secured position the firing pin pushes the trigger bar onto the safety ramp under the influence of the firing pin spring. There is no possibility in this position of the firing pin being released. Yet again, such a drop safety mechanism can only be released by the trigger being pulled backwardly.

Another category of safety mechanisms have been developed for preventing the firing of the weapon by an unauthorized user. For example, in U.S. Pat. No. 5,459,957 a security and safety mechanism is disclosed for a firearm including a disabling unit that interacts with a firearm grip safety in order to enable/disable the firearm. The firearm will remain in a disabled state unless verification means determines that a firearm user is an authorized firearm user. The security and safety mechanism utilizes voice recognition technology wherein a user utters a PIN Code into a microphone of the weapon creating a signal which is processed by a CPU and compared to a previously stored signal in a system memory of the weapon. If the signal is verified as the correct PIN and the correct voice a solenoid is activated to rotate a blocking lever out of the path of a grip safety thereby rendering the weapon ready to fire.

This system has the disadvantage that the voice recognition cannot reliably recognize the voice of an authorized user e.g. when the user is ill (for example has a cold) or is in a hectic or nervous mental condition or when there is loud background noise. All those circumstances can have a very negative influence on the voice pattern of a user. Furthermore, the microphone can be easily damaged or get dirty so that the recording of the voice can be irritated and thus the weapon does not permit firing although the user is authorized. Also anyone with a recording of the authorized persons voice can easily gain access to the weapon.

In EP 0 912 871 B1 a device for securing a firearm is disclosed which comprises a locking mechanism and an identification system for wirelessly exchanging a non-changeable identification code. A transmitter and/or receiver unit is assigned to an authorized user and another is assigned to the identification system. The locking mechanism can be deactivated by the identification system at a distance or in a distance range of 0 to 1000 mm between the transmitter and/or receiver units of the authorized user and the identification system when their identification codes match.

This device has the disadvantage that the transmitter and/or receiver units are in a kind of stand by position wherein a signal is transmitted and can be received and further processed as soon as the transmitter and/or receiver units of the authorized user and the identification system have reached a certain distance between each other. Thus the device has a significant high energy consumption. It is also not clear how the actual mechanism to prevent firing is achieved.

In WO 00/65291 a fire weapon control system is disclosed including safety means for preventing firing of the weapon by an unauthorized user. The system comprises a weapon having a weapon control means including a reader which is lodged in a hollow part of the weapon handle. Said reader comprises a transceiver composed of a signal transmitter means and signal receiver means. The output of the receiver means is used to control the position of the safety means. The system further comprises a user identification element such as a ring or bracelet which is worn by a user of the weapon. Said element has a transponder which is adapted to receive a signal from the transmitter means and to generate a transponder signal back to the weapon. The receiver means in the weapon have recognition means responsive to at least one coded identification carried by the transponder signal and means for generating an output signal to operate the safety means for release of the safety means to the armed position. Furthermore, the handgun control system comprises a switch for connecting a power supply to electric circuits of said control means when the user holds the handle of the handgun or when the pressure is applied to the trigger.

All the above-mentioned safety systems have the disadvantage that the safety systems are only available in newly produced weapons, since it essentially interacts with basic working principle of the firearm. Most of them do not actually explain how the firing is prevented, i.e. do not show the mechatronic interaction. Thus, there is a strong need for a retrofit safety system by which existing weapons can be provided with a safety means against unauthorized use.

It is therefore an object of the present invention to provide an improved safety means for weapons against unauthorized or unintended use. This object of the invention is achieved by the features of the claims.

It is a preferred advantage of the invention to provide retrofitting parts, preferably modular parts, of an already existing weapon with a safety means. It is still another advantage to provide a safety means which ensures maximum possible firing readiness combined with maximum safety for the user and maximum safety against unauthorized use.

According to a first aspect, the present invention provides a retrofit safety means for a weapon which allows recognition of an authorized user and prevents firing of the weapon by unauthorized users. The retrofit safety means is mounted in at least one of the main component parts of a weapon. Therefore, merely the corresponding original main component part of the weapon, without safety means, has to be replaced by a new component part with a safety means according to the present invention. The remaining original main component parts of the weapon can be maintained unmodified.

In particular, a typical pistol comprises five main component parts, namely a slide, a barrel, a recoil spring assembly, a receiver or frame and a magazine. According to a preferred embodiment of the present invention, the safety means is mounted in a slide, such that only the original slide of the pistol has to be replaced by a retrofit slide. The remaining parts, i.e. the barrel, the recoil spring assembly, the receiver and a magazine are maintained unchanged in this preferred embodiment. According to other embodiments of the present invention, the safety means is mounted in other main component parts of the weapon, e.g. with the magazine and/or the receiver, etc. However, since the magazine may be easily exchanged by an original magazine and the receiver is one of the expensive parts it is preferred to exchange the original slide by a retrofit slide according to the present invention. Moreover, in firearms terminology, the receiver is the part of the firearm that houses essential operating parts of the gun. In legal terms, in the United States the receiver is the actual firearm itself, and as such it is the controlled part. Without the receiver the operating of the weapon is impossible. Therefore, the receiver is the part of a firearm housing that bears the serial number. In other words, the slide is not seen as a controlled part of the weapon under the US law.

In order to prevent the dismantling of the weapon by unauthorized users, the retrofit component part may comprise a locker which allows only an authorized person to dismantle the retrofitted weapon. In particular, the locker locks the retrofit component part to one or a plurality of the remaining parts of the weapon. The locker releases the locking if an authorized user has been successfully identified.

The safety means of the present invention preferably comprises an electromechanical safety mechanism with an electromechanical actuator. An actuator transforms an input signal, such as an electrical signal, into a motion. The actuator of the safety means prevents a specific operation of at least a mechanical part of the weapon such that the "ignition chain" is interrupted and a discharge of the weapon is prevented. The term ignition chain refers to the kinematical operation of connected mechanical components which translate a force applied to the trigger to the release of the firing pin, which finally strikes the primer of a cartridge. The actuator is preferably controlled by an electronic control unit. The electronic control unit or an additional electronic circuit controls the authentication of an authorized user.

In particular, the safety means with an actuator according to the present invention mechanically interacts either directly or indirectly via intermediate parts with mechanical elements which takes part in the ignition chain from pulling the trigger to releasing the firing pin, hammer or striker which finally strikes the primer of a cartridge or round. Thus, the interruption of the ignition chain may be achieved by directly interrupting the ignition chain, i.e. the actuator blocks a mechanical component which takes part of the ignition chain, e.g. the trigger, the firing pin etc. The interruption may also be achieved by an indirectly blocking, i.e. a mechanical component which takes not directly part of the ignition chain is blocked. For example, a firing pin safety blocks the firing pin from an accidentally firing of the weapon. However, such a firing pin safety pin is not necessary to forward the initial force, which has been applied to the trigger, to the firing pin. According to the present invention, also such components, which take somehow indirectly part of the ignition chain may be blocked to interrupt the ignition chain. In other words, the safety means is adapted to engage via its actuator with elements of the ignition chain to enable or disable its operation. For instance, the actuator may act on the trigger, the trigger bar, the firing pin and a firing pin safety pin and disable or redirect the applied force to the trigger in an operation that interrupts the ignition chain and therefore the discharge of the cartridge.

According to an embodiment of the present invention, in the disabled or safety state of the safety means, a latch biased by a spring interrupts or blocks a mechanical part which takes part in the ignition chain. If no authorizing signal is received, the latch is biased into the safety position, i.e. the weapon cannot be discharged, neither accidentally nor by any unauthorized user. If an authorized user is identified, an actuator transforms an electrical input signal (user is authorized) into a motion of the latch such that the latch does not block or interrupt the operation of the ignition chain anymore. Thus, once a proper authorization signal is received by the electronic control unit, the actuator moves the latch to an unengaged position, such that the ignition chain is not longer blocked or interrupted and a pulled trigger will translate into firing of the weapon. According to another embodiment of the invention the actuator may engage with the mechanical part directly, e.g. the actuator comprises an movable actuator pin which engages with the mechanical part in the locking position and releases the mechanical part in the unlocked position. According to another preferred embodiment, the actuator engages with the mechanical part(s) of the weapon via intermediate parts, such as the above described latch or an additional engaging pin. According to yet a further embodiment, the intermediate parts are biased by a biasing means. This provides the advantage that the energy or force for the movement of the latch or the engaging pin is buffered by the biasing means. Thus, in cases when the mechanical part of the ignition chain which should be blocked, is slightly displaced (e.g. the trigger is slightly pulled) such that the actuator can not move latch or the engaging pin into an engaged position, the biasing means buffers the energy and moves the latch or the engaging pin later in the engaged position when the slightly displacement vanishes (trigger is not pulled anymore). For such an movement into the engaged position the actuator has not to be active anymore, since the energy for the movement is buffered by the biasing means. The same principle may also be used for the releasing of the latch. According to a preferred embodiment, the biasing means is a spring, e.g. a compression spring or a tension spring.

It is preferred that the mechanical and/or electronic locking process is ensured regardless of the position/state of the weapon parts during the switching process. Thus, it is preferred, that the switching from unlocked in locked (operative to non-operative) is ensured regardless of the position/state of the weapon parts during the switching process.

The mechanical parts which engage with other parts of the ignition chain are preferably constructed such that any manipulation from outside, i.e. external acceleration forces, magnetic fields etc., do not allow a movement from an engaged position to an unengaged position and vice versa. This can be achieved for example by supporting the relevant mechanical parts in their center of gravity. Moreover, it is also preferred that the actuator applies its force on the (safety) latch not directly but indirectly. According to one embodiment of the present invention, the actuator moves a first disk which is connected with the latch via a spring. With such a mechanism, the latch may be positioned in one of two stable positions, wherein force to move the latch from one position is provided by said spring. The actuator merely induces in which of the two stable positions the latch should be positioned.

The safety means according to the present invention may comprise several operation modes. One operation mode, in the following called "permanent signal mode", allows firing only for the time period in which an authorization signal is received by the electronic control unit. In other words, the weapon is only operative for the duration in which an authentication signal is received. In order to save transmission energy, the transmission of authentification signals can be pulsed, such that permanently means e.g. every two seconds, every three seconds or something like that. This provides the advantage that the weapon switches immediately from operative to non operative when no signal is received. This may happen when the received signal strength is to weak, e.g. when the transponder is to far away or any other interruption weaken the signal. The weapon may also switch to non-operation mode in case the transponder leaves the "operation radius", which will be discussed below in further detail.

In a further embodiment of the present invention, the safety means can be operated in a "flip-flopmode", i.e. both states (locked/unlocked) are stable and changing the status from locked to unlocked requires an authentication signal as well as changing the status from unlocked to locked. According to an preferred embodiment, the safety means may allow a user to select his preferred mode out of several modes.

According to an embodiment of the present invention, the safety means may comprise a counting means for counting shots. This counting means may count any shot made with munitions and/or shots which are made without munitions. In certain embodiments the counter may be programmable by an authorized user or by a "superuser" which allows a detailed monitoring of the weapons use. Typically, a shot may be identified and counted on the basis of the movement of the firing pin. However, since an external influence like an acceleration of the weapon, e.g. dropping the weapon on the floor, may also result in a movement of the firing pin, the counting means is preferably adapted to distinguish trigger induced firing pin movements (i.e. movements which result in a proper shot) from firing pin movements which are the result of an external influence. This can be achieved for example by monitoring the movement pattern or the movement characteristic of the firing pin. For example, the trigger induced firing pin movement is defined by a specific back and forward acceleration characteristic which is different from the firing pin accelerating characteristic induced by external forces. Therefore, the counting means may measure the acceleration of the firing pin and distinguish based on this measurement whether the movement of the firing pin was trigger induced or based on external forces.

According to an embodiment of the present invention, the authorized user is identified by recognizing an identification code allowing the releasing of the mechanical mechanism of the safety means. Preferably, the electronic control unit, which conducts the authentication of an authorized user, communicates with an external authenticating device. The communication can either occur wirelessly, e.g. with an external transmitter, responder or transponder (herein generally referred to as "transponder") or can be wired.

If the communication is wired, the safety means is connected to the external authenticating device through a wire (preferably with a plug). This may be a suitable set-up in a shooting range or shooting stand, where the guns first must be connected to the external authenticating device, and the user must enter the authentication information (PIN code, biometric) before the firearm can be used. However, generally a wireless communication between the safety means and the external device is preferred.

In case of a wireless communication, the safety means according to the present invention may further comprise means for precisely measuring the distance between the authenticated user and the weapon. With such a distance measurement a well-defined operation range or operation radius can be defined, i.e. a well-defined radius around the transponder within which the weapon can be fired after positive authentication. According to a further embodiment, the range of the operation radius can be programmed. For example, in a shooting stand a larger operation radius may be advantageous whereas a policeman may prefer a smaller radius when wearing the weapon during patrol.

The above discussed "flip-flop" mode may be combined with such a distance measurement or may work without any such distance measurements.

The wireless communication between the electronic control unit in the safety means and the external device can be of any type or frequency suitable for the purpose, for example Low frequency (LF, e.g. 25 kHz with magnetic induction), radio-frequency (RFID, e.g. 13.56 MHz) or high-frequency (e.g. 868 MHz, 915 MHz, 2.4 GHz or higher) and use any type of either standardized (e.g. Bluetooth, ZigBee) or proprietary communication protocol or a combination of both. "Communication" in this sense shall be any kind of transmission or exchange of data and can be either encrypted or open and can be either unidirectional or bidirectional. A person skilled in the art will choose the appropriate approach and combination according to the desired properties of the system, e.g. optimization in terms of signal range, transmission speed, battery life time, cost or robustness against external electromagnetic noise, or other criteria. Either the control unit or the external device or both may have an own power supply. The power supply may comprise either a battery, a fuel cell, a piezo and/or a solar cell. In a preferred embodiment both the control unit and the transponder will have their own battery. If either the control unit or the transponder do not have an own power supply, the wireless communication shall not only transmit data, but also energy. In yet another preferred embodiment the battery of the retrofit part and/or the battery of the transponder may be charged by a charging device, if the operation mode of the weapon requires a large amount of energy (permanent communication with the transponder). Such a charging device may be worn by a user, e.g. the batteries of the weapon and/or the transponder are charged when the weapon and/or the transponder is carried by the user. The charging of the weapon may be achieved by an additional battery pack worn by the user, wherein the energy is transmitted to the weapon either via electrical contacts, e.g. electrical contact between the holster and the weapon in the holster, or wireless e.g. inductive.

The communication between the transponder and the control unit may either be initiated by the transponder or by the gun, whereas the other component is in a listen mode and is able to detect whether a communication shall be initiated.

The transponder may comprise a switch for activating the transponder for a given period of time for emitting the authenticating signal. This has the advantage that the transponder can also be activated by a user and is only then, within a given period of time, able to send the authenticating signal. In the preferred embodiment the transponder further comprises a biometric sensor, preferably a fingerprint sensor, for identifying an authorized user before activating the transponder for a given period of time for emitting the authenticating signal.

This prevents a misuse of a weapon and the respective safety device in case a non-authorized user is in the possession of the weapon with the safety device and the respective transponder.

According to another embodiment of the invention a safety disconnector is provided, preferably at the transponder, which is adapted to de-activate the transponder and/or the safety means in situations in which a non-authorised user wants to use the transponder or the weapon. This is particularly useful in case the weapon is in the hand of a non-authorised user but within the range of activity of the transponder. In this case the safety disconnector, e.g. at the transponder, can be used to de-activate the safety means of the weapon so that the non-authorized user cannot fire the weapon.

According to another embodiment of the invention, the safety means has an additional switch, button or the like (e.g. a contact plate), that is suitable to detect whether the firearm is in the holster or not. Such a switch may be used to switch the control unit in the gun from a "sleep mode" (where it does not consume energy at all) into a "communication" mode when removed from the holster, where it is either able to detect whether the transponder wants to initiate a communication and/or will automatically try to initiate the communicate with a transponder.

The present invention furthermore provides a method corresponding to the functions and functional relations.

The retrofit safety means according to the present invention provides the advantage that no complicated and costly changes in the construction of the weapon have to be made and only a main component part of an existing weapon has to be replaced such that costs can be reduced significantly.

In the following the term weapon is used for all kinds of firearms up to Cal. 20 mm, independent from the firemode "Single or automatic" fire.

The term "ignition chain", as used in the present application, preferably refers to the operation of parts which translate an applied force to the trigger to the strike of the firing pin. The ignition chain starts with the pulling of the trigger up to the release of the firing pin which strikes the primer of a cartridge. An interruption of the ignition chain refers to a blocking of at least a movement of a mechanical part such that the trigger cannot be pulled to the rear end when the safety means is in a safe position. The interruption may also redirect a force of a mechanical part such that the trigger can be pulled to the rear end but the force does not translate into the striking of the cartridge.

The term "actuators" refers to devices which transform an electrical input signal into motion. Electrical motors, ultrasonic motors, relays, comb drive, piezoelectric actuators, thermal bimorphs, shape memory alloys, digital micromirror devices and electroactive polymers are some examples of such actuators.

The invention will now be described with reference to the Figures in which

Figure 4:
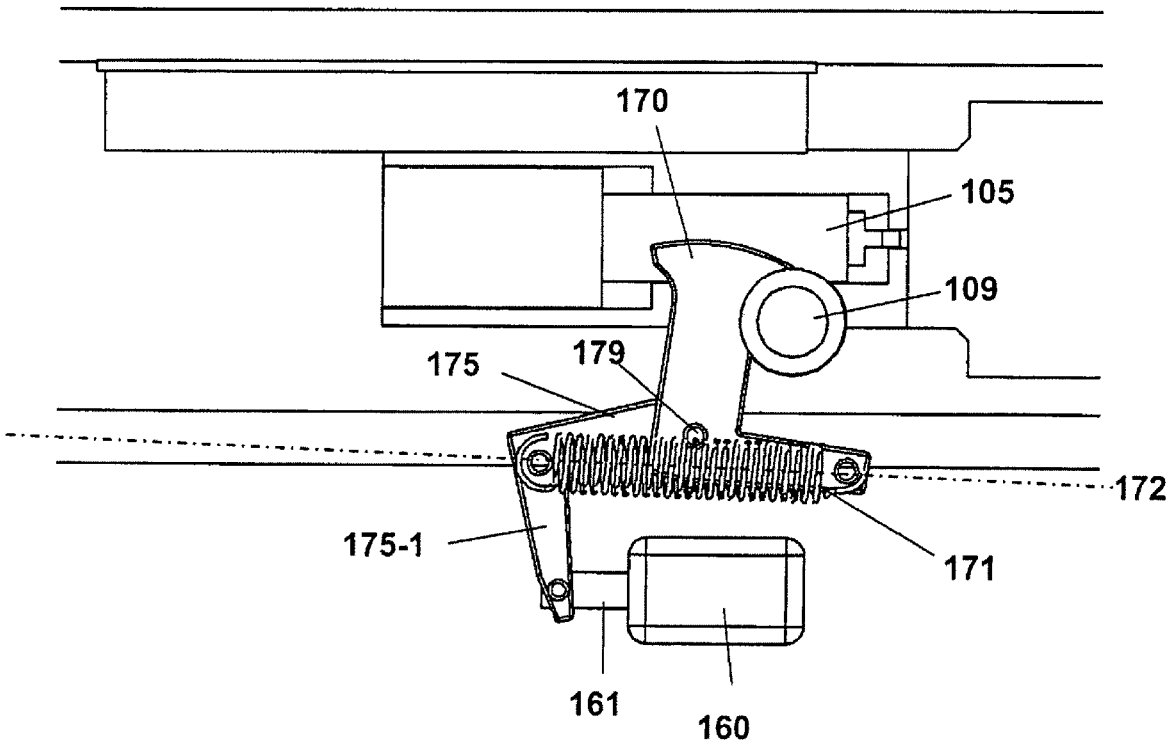
FIG. 4 shows an embodiment of the invention wherein the actuator of the safety means blocks a safety pin (safe or disabled state)
Figure 5:
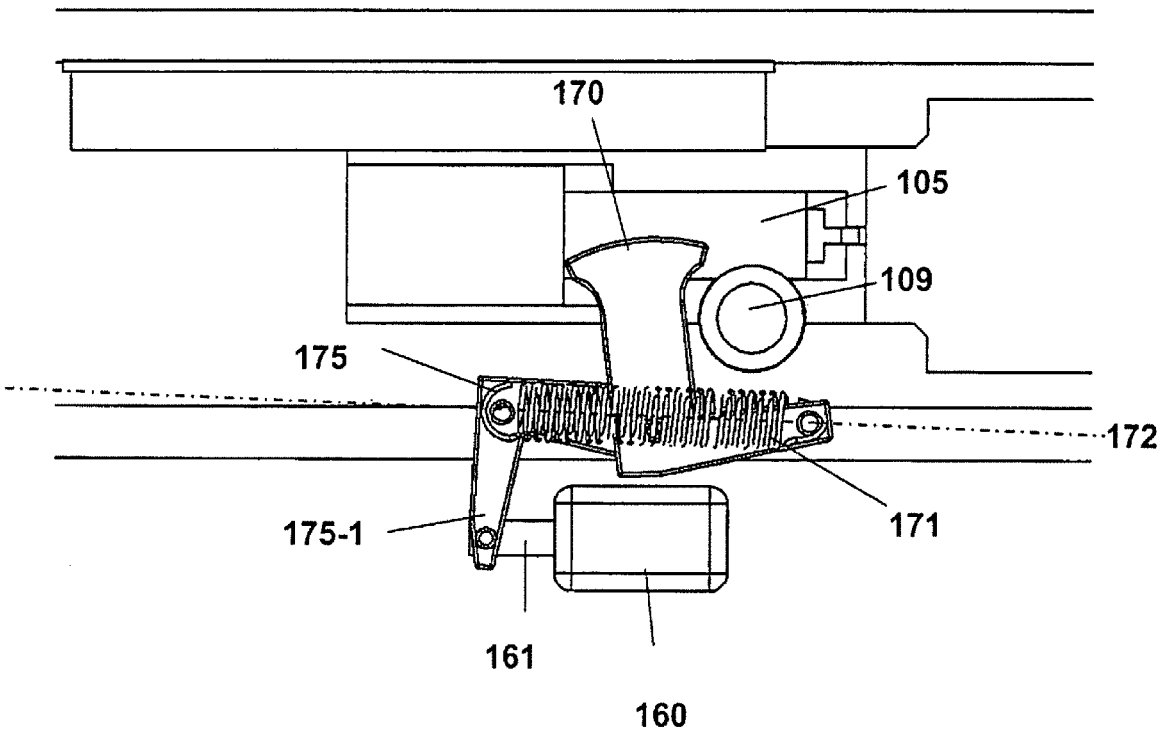
Figure 6:
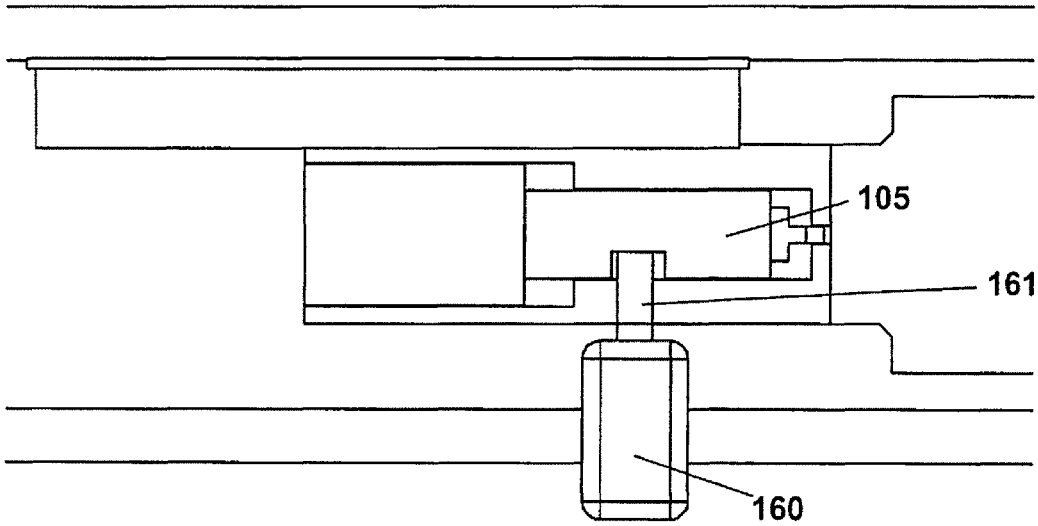
Figure 7:
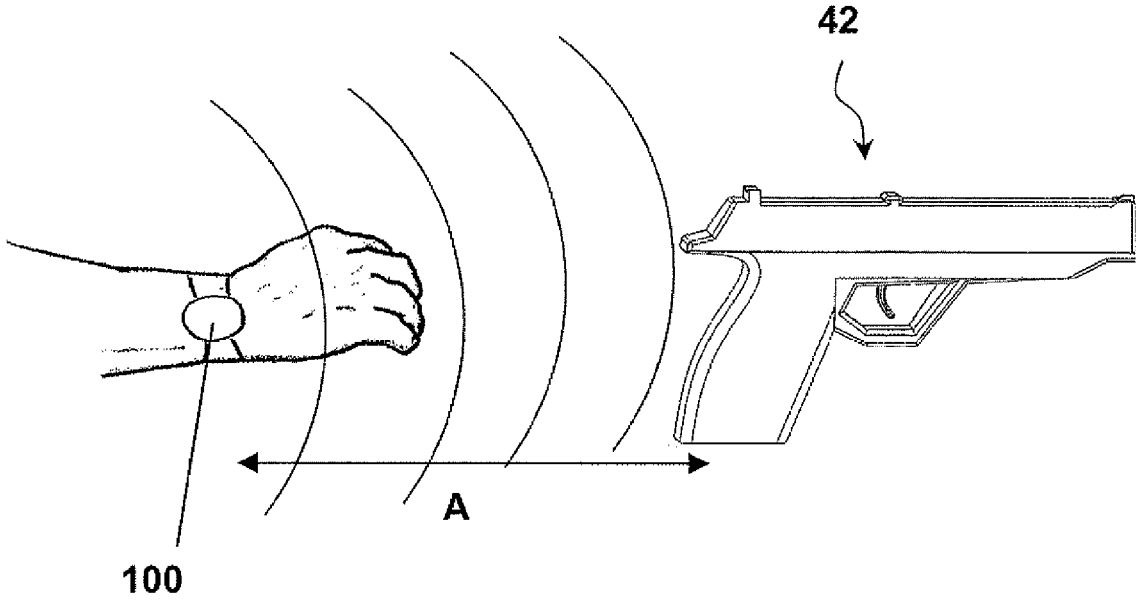

FIG. 5 corresponds to FIG. 4 but shows the safety pin in a released state (firing enabled state);

FIG. 6 shows a further embodiment of the invention wherein the actuator of the safety means blocks a firing pin directly (safe or disabled state);

FIG. 7 shows the authentication via a transponder worn by a user in form of a wristwatch.

Weapons typically utilize triggers to initiate the firing of a cartridge or round in the firing chamber of the weapon. This is accomplished by actuating a striking device through a combination of spring and kinetic energy operating through a firing pin to strike and ignite the primer of the cartridge (see ignition chain as defined above). There are two major types of striking mechanisms, hammers and strikers. Hammers are typically spring-tensioned masses of metal that preferably pivot on a pin when released and strike a firing pin to discharge a cartridge. Strikers are, substantially, spring-loaded firing pins that travel on an axis in-line with the cartridge eliminating the need for a separate hammer. The present invention may be provided with any kind of strikers. However, in the following an exemplary embodiment of the present invention will be described with respect to a pistol which comprise preferably spring-loaded firing pins.

There are a plurality of connecting parts and corresponding mechanisms between the trigger and the firing pin. The safety means according to the present invention is adapted to interrupt at least at one point the operation of the plurality of connecting parts, corresponding mechanisms and/or kinematic energy operations between the trigger and the firing pin, i.e. the safety means is adapted to interrupt the ignition chain in case the user is not authorized. The interruption of the ignition chain can take occur at any location.

According to an exemplary embodiment, the safety means may be provided within the receiver, wherein an actuator engages directly with the trigger in the unauthorized state. The safety means directly prevents that the trigger can be pulled backwards, i.e. the safety means blocks the trigger directly. Hence, the safety means blocks the mechanism of the ignition chain in the beginning. However, the safety mechanism may also interrupt the mechanism of the ignition chain such that any force applied to the trigger will not be forwarded to a following component such that the trigger may be pulled backwards, but without an effect on the firing pin. The blocking or interruption of the ignition chain at such an early stage provides the disadvantage that the following mechanisms may be manipulated so that finally the firing may be achieved even that if the safety means blocks the trigger. It is therefore more preferred to block or interrupt the ignition chain at a very late stage.

Figure 1:
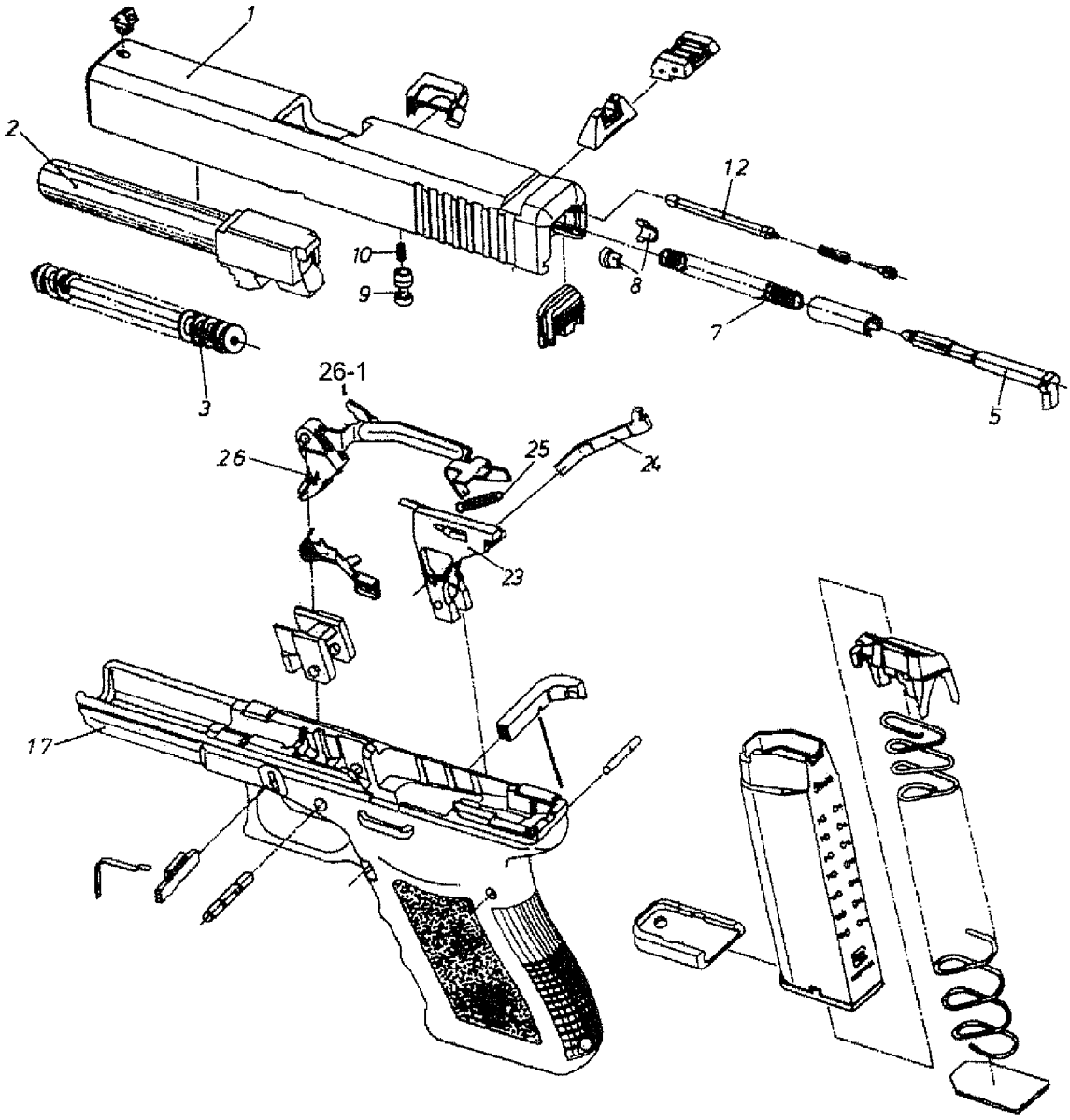
FIG. 1 shows an exploded drawing of a self-loading pistol.

In the following the function of a self-loading pistol will be exemplary explained with regard to FIG. 1, which shows a self-loading pistol, e.g. a Glock 17™. In a loaded state a round or cartridge is in the barrel 2 and the firing pin 5 is partially tensioned by the firing pin spring 7. The firing pin is secured against accidental firing by a firing pin safety pin 9. The safety pin 9 is located in it lower position between the firing pin and the cartridge such that the firing pin 5 cannot act on the primer of the cartridge. The safety pin 9 is biased to the lower position (safety position) by a safety pin spring 10. The trigger 26 is in the foremost position. In case the trigger 26 is pulled, a protrusion 26-1 of the trigger bar (a mechanical extension of the trigger, i.e. a mechanical part taking part in the ignition chain) gets into contact with the safety pin 9 and provides a force against the safety pin spring 10. In case said force is larger than the biasing force of the spring, the safety pin 9 is moved in an upper position allowing that the firing pin 5 may act on the primer of the cartridge. As the trigger 26 is pulled back further, the trigger bar releases the firing pin 5 by means of a connector 24. The released firing pin 5 is accelerated and acts directly on the primer of the cartridge since the safety pin 9 in the upper position does not block the movement of the firing pin 5. It should be noted that further mechanical components which are not illustrated or illustrated, e.g. the components are numbered with numbers 3, 8, 7, 12, 23, 25, take somehow part in the ignition chain either directly or indirectly.

Figure 2:
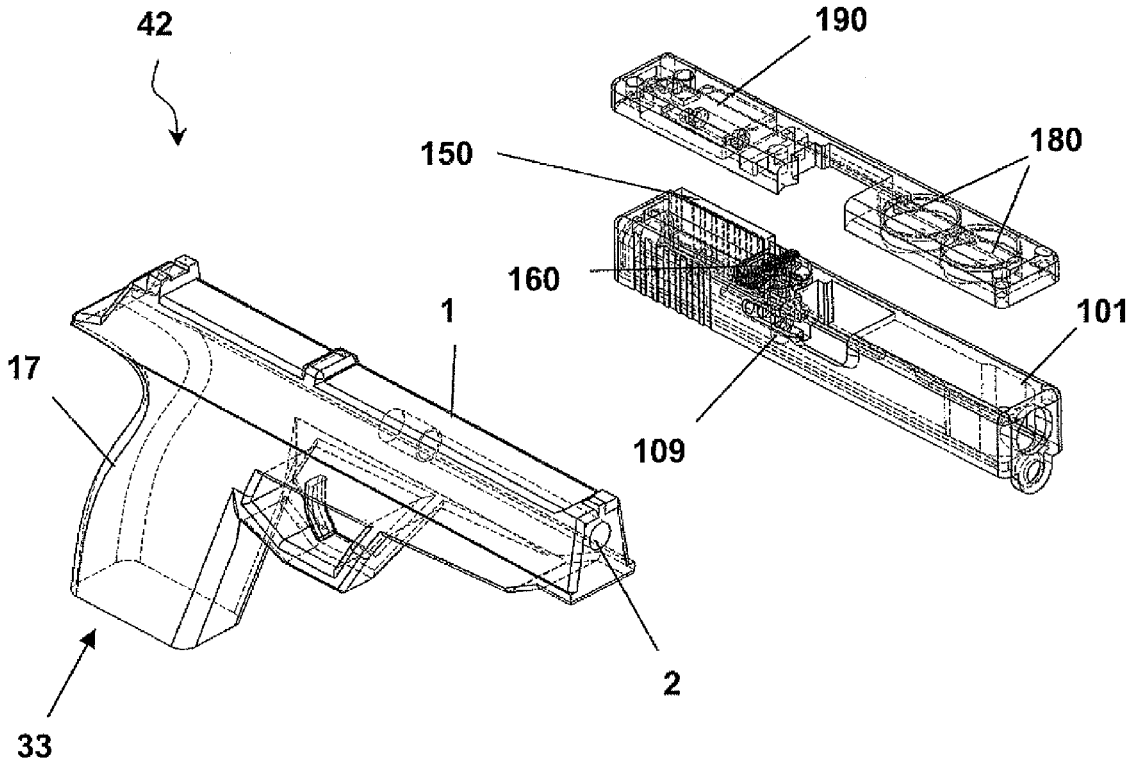
FIG. 2 shows a drawing of a self-loading pistol and a retrofit slide with a safety means according to the present invention.

FIG. 2 shows an original weapon 42 with the main component parts: slide 1, barrel 2, recoil spring assembly (not shown), receiver 17 and magazine 33 inside the receiver 17. FIG. 2 further shows a retrofit slide 101 in a partly transparent and exploded view (exploded into two parts). The original weapon 42 can be converted into a weapon with a safety means by simply replacing the original slide 1 by the slide 101. Preferably, the design of the retrofit slide 101 is similar or equal to the original slide 1 of the weapon 42. The retrofit slide 101 according to the present invention comprises a safety means with an electronic control unit 150 with an antenna 190, a firing pin safety pin 109, an actuator 160 for moving a latch 170 in an engaged and disengaged position with the safety pin 109 and a battery 180 as a power supply for the actuator 160. The safety pin 109 provides the same function as the original safety pin 9, namely preventing the weapon from accidental discharge (e.g. in case the weapon drops).

Figure 3:
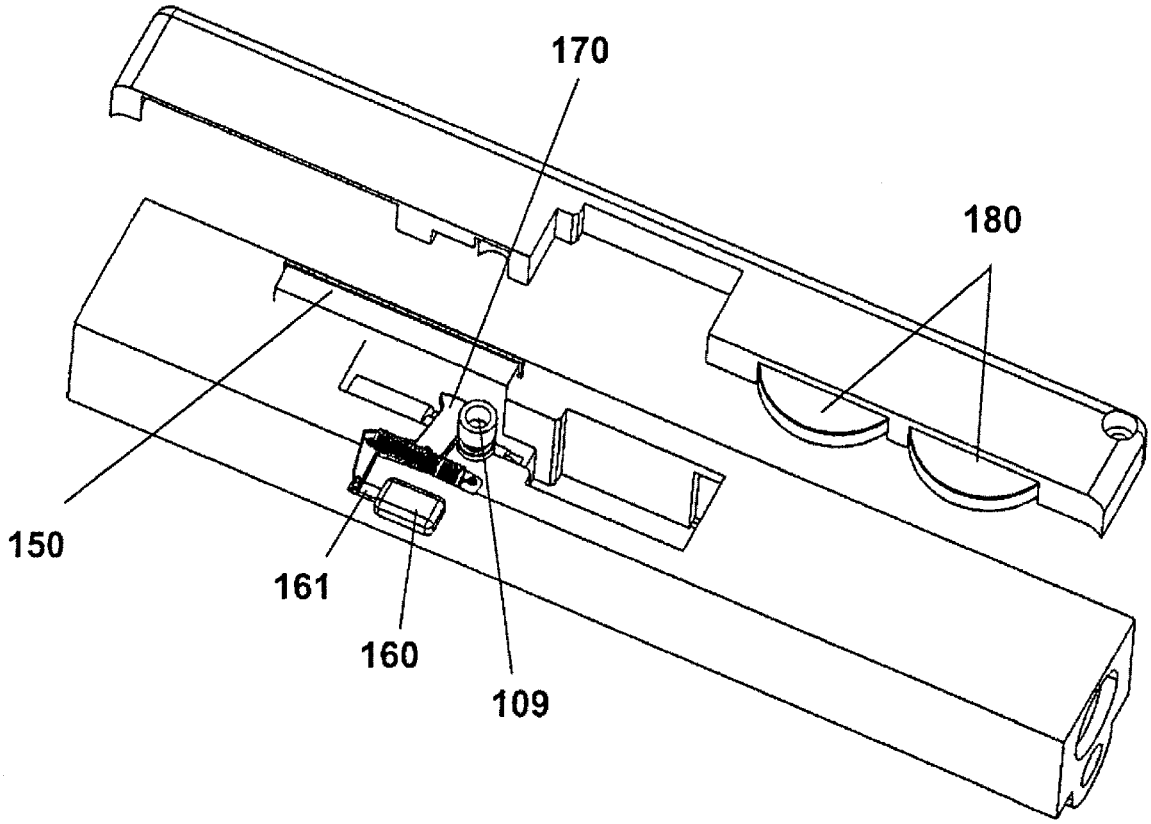
FIG. 3 shows an enlarged view of the retrofit slide with a safety means according to the present invention.

FIG. 3 shows an enlarged view of the retrofit slide with a partly cut cover. As can be seen from FIG. 3, the safety pin 109 is also biased by a safety pin spring 110 into the lower position. In case the safety pin 109 is in the lower position, a firing pin cannot act on the primer of a cartridge in the barrel, i.e. the safety pin 109 is located between the firing pin and the barrel. However, in contrast to the accidental safety mechanism, the present invention provides a further safety means that prevents firing by unauthorized users. In the safety state, i.e. a user is not identified as authorized, the firing of the weapon is prevented by blocking the movement of the safety pin 109 with a latch 170. The actuator 160 and the latch 170 are in the locked or safety position. Like in the prior art mechanism, a trigger bar extension 26-1 may apply a force on the safety pin 109 but this force does not allow the movement of the safety pin in an upper position as the movement of the safety pin is blocked by the latch 170. Therefore, the movement of the trigger bar 26 is blocked and the firing pin 5 is prevented from acting on the cartridge.

In case 150 identifies an authorized user, the electronic control unit controls the actuator 160 to move the latch 170 in a release position, i.e. the latch does not engage with the safety pin 109 such that safety pin 109 can move to the upper position when an extension 26-1 of the trigger bar applies an upwardly directed force to the safety pin 109. Hence, in case the latch 170 is in the released position the safety pin 109 ensures that the weapon can only be released by the trigger being pulled to the rear, i.e. the safety pin prevents the weapon from accidental firing.

As an actuator 160, any type of motors may be used. Motors are preferably used when a circular motion is needed, but can also be used for linear applications by transforming circular to linear motion with a bolt and screw transducer. The embodiment in FIG. 3 shows piezoelectric actuators as an intrinsically linear actuator. Such a piezoelectric actuator 160 provides the advantage that it can be made very small, provides a sufficient force for the movement of the latch 170 and requires only a small amount of energy. Thus, the battery 180 provides enough energy for many thousand movements of the latch.

FIG. 4 shows an enlarged view of an actuator 160 in a safety position similar as previously shown in FIGS. 2 and 3. The latch 170 engages with the safety pin 109, such that the firing pin 105 is not allowed to move into a position which would allow the firing pin to hit the primer of the cartridge. Preferably, the latch 170 is biased into the engaging position (safety position) by a latch spring 171, such that the weapon is secured against unauthorized use in an electrical powerless state.

In particular, the mechanism shown in FIG. 4 comprises a latch 170 and a disk 175, both mounted in their center of gravity on a common axis 179. A biasing spring 171 is mounted between the disk 175 and the latch 170, wherein the spring provides the force for moving the latch from a engaged position into an unengaged position and vice versa. In other words, due to this mechanism, wherein the force of the actuator is buffered by the spring, two stable positions, i.e. engaging and unengaging position, are achieved. Due to this mechanism a fast switching between the engaged and unengaged position is achieved. Since the latch 170 and the disk 175 are both mounted in their center of gravity on a common axis 179, the mechanism is insensitive on external forces, i.e. the latch may not be manipulated easily by external forces.

The latch 170 engages in the safety position with the safety pin 109, such that the firing pin 105 is not allowed to move into a position which would allow the firing pin to hit the primer of the cartridge. Preferably, the latch 170 is biased into the engaging position (safety position) by a latch spring 171, such that the weapon is secured against unauthorized use in an electrical powerless state. The center line 172 of the spring 171 is depicted in this stable engaging position on the lower side of the common axis 179.

Once the electronic control unit 150 receives a proper authentication signal, the actuator 160 is provided with electrical power such that the actuator pin 161 provides a force against the leg 175-1 of the disk 175. Said force acts against the force of the biasing spring 171. In this state the biasing spring is loaded or buffers the force to move the latch into from the engaging position into the unengaged position. However, since center line 172 of the spring 171 is on the lower side of the axis 179 (FIG. 4), the latch 170 is in a stable position and does not move into the second stable position, i.e. the unengaging position. A further movement of the actuator pin 161 moves the leg 175-1 further upward or to the left until the center line 172 of spring 171 crosses the axis 179. In this position, the mechanism is in a instable maximum, i.e. a minimal amount of force will either switch into the engaged or unengaged position. Since the actuator pin 161 still applies a force against the leg 175-1, the latch 170 switches into the stable unengaging position as shown in FIG. 5. In this stable position, the center line 172 of the spring 171 is positioned above from the axis 179.

According to a further aspect of the present invention, retrofit compartments may be provided for any kind of weapon. For example, FIG. 6 shows a part of a retrofit slide 1 of the present invention, wherein the weapon does not comprise a firing pin safety mechanism, like the weapon in FIG. 1. In this case, it makes no sense to block a firing pin safety pin. Therefore, the actuator 160 blocks directly the firing pin 105 by means of the actuator pin 161. In the blocked position, the actuator pin 161 engages with the firing pin 105. Once the electronic control unit 150 receives a proper authentication signal, the actuator 160 is provided with electrical power such that the actuator 160 releases the engagement between the actuator pin 161 and the firing pin 105. As described already above, there could also be a biasing means, like a spring, between the actuator pin and an engaging pin, which engages with the firing pin. The biasing means buffers the energy for the movement from the actuator and moves the engagement pin into the engaged position, when the recess of the firing pin and the engagement pin are proper aligned. It is clear to a person skilled in the art that also the firing pin safety pin 109 my be blocked by the actuator 160 directly, i.e. without the mechanism of disk 175 and latch 170. Vice versa it is also obvious to a person skilled in the art, that in case the weapon does not comprise a firing pin safety pin, the firing pin 105 can be controlled by a mechanism with a disk 175 and latch 170.

It is obvious from the detailed description of the above exemplary embodiment that there can be numerous mechanical components in kinematical operable connection for transmitting the applied force to the trigger to a release of the firing pin which allows the acting of the firing pin to the cartridge. According to an aspect of the present invention, the firing of a weapon can be prevented by a safety means which blocks any of said numerous mechanical components from its movement and/or redirects a force applied to any one of said numerous mechanical components such that a pulled trigger does not result in the discharge of the weapon. In other words, if an authorization signal is not obtained (either because no authorizing device is present to give an authorizing signal or no proper signal is received), the safety means interrupts the ignition chain such that pulling the trigger will not cause the weapon to discharge. On the other hand, if an authorization is obtained, the safety means does not interrupt the ignition chain such that a pulled trigger is translated into a movement of the firing pin which finally strikes the primer of the cartridge and discharges the firearm. According to the present invention, such a security means is preferably provided in a retrofit compartment of the weapon.

The retrofit component part according to the present invention may comprise any input means for receiving an authentication code. According to a preferred embodiment of the present invention, the safety means receives, via antenna 190, a preferably encrypted authentication signal from an external transmitter or transponder. FIG. 7 shows a transponder 100 worn by an authorized user as a wristwatch. The transponder can also otherwise be adapted to be carried by an authorized user of the weapon, or as an alternative the transponder 100 can be installed in an area where one or more users of a weapon are allowed to use the weapon, e.g. in a shooting stand. This has the advantage that a localization can be achieved by an installation of one or more transponder stations at fixed positions, e.g. in a riflemen's club-house.

The transponder 100 emits an authenticating signal to the safety means in case the user is authorized to use said weapon 42. The safety means receives and further processes the authenticating signal from the transponder 100 to permit firing of the weapon 42 by the user in case the authenticating signal from the transponder 100 authenticates an authorized user.

In an embodiment of the invention, the safety means comprises an electronic control unit 150 to control the safety means, in particular the actuator 160. When the safety means receives the authenticating signal from the transponder 100, said signal is processed in said electronic control unit 150 which actuates the actuator 160 to release the protection of the weapon in case a user is identified as authorized thereto.

In case the user of the weapon 42 is not authorized, the transponder 100 emits no signal or a signal which does not authenticate the user as authorized. In the latter case the safety means which has received the signal from the transponder 100 recognizes that the signal is not an authenticating signal and therefore does not communicate to the actuator of the weapon to release protection of the weapon or does even block the safety means in the weapon e.g. for a given period of time.

In an embodiment the transponder 100 does not send a signal in case a user is not authorized. Thus the weapon 42 remains blocked since the safety means do not receive an authenticating signal from the transponder 100.

In a preferred embodiment of the invention the safety means and the transponder 100 communicate with each other by a bidirectional wireless signal transmission which is more preferably based on a challenge response algorithm. This has the advantage that the reliability of the identification can be further improved.

In an embodiment of the invention the transponder 100 comprises a biometric sensor for example a fingerprint sensor to identify an authorized user before the transponder 100 is activated for a given period of time to emit an authenticating signal. This has the advantage that the security can be further improved since an unauthorized user cannot activate the transponder 100 to emit an authenticating signal. Furthermore, additional security features can be integrated in the transponder 100 such as e.g. the biometric sensor described above to verify if a user of the transponder 100 is authorized thereto etc. without the necessity of changing the construction of the weapon. Some other additional security features will be described in the following.

As an alternative to the biometric sensor or in addition thereto, the transponder 100 can be provided with a key (keys) to enter a personal code(s) (e.g. a PIN-code) for identifying an authorized user before the transponder 100 is activated to emit an authentication signal. It is clear that the invention is not limited to the biometric sensor and the keys for entering a code(s) to identify an authorized user(s) of the transponder. Any other sensors or devices suitable to identify an authorized user are within the scope of the invention.

The transponder 100 can be further configured to provide an authenticating signal within a certain range A as depicted in FIG. 7, preferably up to 10 m (e.g. in a shooting stand), more preferably up to 5 m, even more preferably up to 1.5 m or more preferably up to 30 cm. This is advantageous for example when the transponder 100 has a fixed position e.g. in a shooting stand in which the transponder 100 is used to activate a weapon (weapons) therein. This allows e.g. that a transponder 100 can be located or worn in a protected area in which the transponder 100 is protected e.g. from being damaged or from attempts of manipulation etc. so that the transponder 100 can be activated and emit an authenticating signal to the safety means of the weapon 42 e.g. outside said protected area. It is clear that the range in which the transponder 100 is configured to provide an authenticating signal can be varied depending on the field for which the transponder is used. That means that the invention is not limited to the range as mentioned above but can also provide a range considerably larger or smaller.

As mentioned before the transponder 100 can be adapted to be carried or worn by a user e.g. on the body, in a pocket or as a ring or a bracelet etc. As an alternative the transponder 100 can be also adapted to be mounted e.g. in an area for using weapons such as e.g. a shooting stand or in a private area or in a particular protected area.

In an embodiment of the invention the transponder 100 can be configured to be used for different users of the weapon of the safety device. This has the advantage that one transponder 100 can be used for different users of a weapon 42.

Preferably the transponder 100 and/or the safety means correspond with each other and/or are programmable in order to authorize a user or a group of users. The transponder 100 and/or the safety means communicate with each other and/or are preferably programmable on a wireless basis.

In a further embodiment of the invention different transponders can be used for different users of the weapon of the safety device. This has the advantage that the weapon 42 can be actuated by different users having their own transponder 100.

In a further embodiment of the invention, the request signal and/or the authenticating signal can be communicated by a frequency of approximately 25 kHz.

Furthermore, the safety means of the invention can be adapted to permit firing of the weapon 42 under certain conditions once the safety means has received an authenticating signal from an authorized user.

As an alternative or in addition the safety device can permit firing of the weapon 42, e.g. for a given number of shoots and/or for a given period of time and/or in a certain transmitting range which must not be left by the user (e.g. a range of preferably approximately 80 cm when the transponder is not installed at a fixed position and a range up to 1.5 m in case the transponder is located at a fixed position). Preferably the given period of time and/or number of shots can be varied for different transponders 100 of different users of the weapon.

More preferably, the past activity of the weapon 42 can be documented. In this case, the safety means can be regularly interrogated or inquired.

Further, the activities of the transponder 100 and/or the safety means are preferably logged and readable by a computer. This has the advantage that the activities of the weapon can be reconstructed and e.g. directly stored in the computer similar to a black box in airplanes.

Moreover, the transponder 100 can be adapted to also communicate with a compartment for weapons, such as a locker, in order to give an authorized person access to the compartment. This has the advantage, that the transponder 100 can be also used to prevent that an unauthorized user can open the compartment for weapons.

It is obvious for the person skilled in the art that the present invention is not limited by what has been particularly shown and described hereinabove. Rather the scope of the present invention includes both combinations and sub-combinations of the features described hereinabove as well as modifications and variations thereof which would occur to a person skilled in the art upon reading the foregoing description and which are not in the prior art.

The invention claimed is:

1. A safety device for weapons with:

an electronic control unit for the authentication of an authorized user and the control of a safety mechanism, wherein the safety mechanism mechanically engages with a firing pin or a firing pin safety pin of the ignition chain so that said ignition chain is interrupted and firing is prevented, wherein the safety mechanism comprises an actuator for releasing said engagement of the safety mechanism in case the electronic control unit identifies an authentication signal, the safety device is provided in a retrofit slide of the weapon; and wherein the safety mechanism comprises an engaging latch for engaging with the firing pin or the firing pin safety pin, wherein the engaging latch is mounted in its center of gravity.

2. The safety device according to claim 1, wherein the actuator is one of the group consisting of an electrical motor, ultrasonic motor, relay, comb drive, piezoelectric actuator, thermal bimorph, shape memory alloy, digital micromirror device and electroactive polymer.

3. The safety device according to claim 1, further comprising means for precisely measuring the distance between the authenticated user and the weapon.

4. The safety device according to claim 1, further comprising a device to measure acceleration of the weapon or the firing pin.

5. The safety device according to claim 1, further comprising means for counting and discriminating shots with and without munitions.

6. The safety device according to claim 1, further comprising a device capable of distinguishing between users and thereby enabling a preferred mode of various modes of operation.

7. The safety device according to claim 1, further comprising a device to mechanically or electronically ensure either locked or unlocked state, regardless of the position of the weapon parts during the switching process.

8. Safety system comprising:

a safety device according to claim 1, and a transponder for authenticating at least one authorized weapon user carrying or wearing the transponder or for authenticating an allowed area for using the weapon.

9. The system according to claim 8, wherein the transponder is adapted to emit a wireless cryptified authenticating signal.

10. The system according to claim 8, wherein the safety device and the transponder communicate with each other wirelessly, by a bidirectional wireless signal transmission, based on a Challenge response algorithm, with a frequency of 25 kHz or via blue tooth interfaces.

11. The system according to claim 8, wherein the transponder comprises a switch for activating the transponder for a given period of time for emitting the authenticating signal.

12. The system according to claim 8, wherein the transponder comprises a biometric sensor, a fingerprint sensor, for identifying an authorized user before activating the transponder a given period of time for emitting the authenticating signal.

13. The system according to claim 8, wherein the transponder comprises keys for entering a personal code for identifying an authorized user before activating the transponder a given period of time for emitting the authentication signal.

14. The system according to claim 8, wherein the transponder can be configured to provide an authenticating signal within a range of less than 1.5 m.

15. The system according to claim 8, wherein the transponder is either a relatively small device to be constantly carried or worn by the user or a stationary device to be mounted in an area for using weapons, such as a shooting-stand.

16. The system according to claim 8, wherein different transponders can be used for different users of the safety device.

17. The system according to claim 8, wherein the safety device is adapted to permit firing of the weapon for a given number of shots or for a given period of time once it has received an authenticating signal from an authorized user, wherein the period of time can be varied for different transponders of different users of the safety device.

18. The system according to claim 8, wherein the transponder is adapted to also communicate with a compartment for weapons, such as a locker, in order to give an authorized person access to the compartment.

19. The system according to claim 8, wherein the transponder or the safety device is programmable in order to authorize a user or a group of users.

20. The system according to claim 8, wherein the safety device is programmable wirelessly, by a bidirectional wireless signal transmission, based on a Challenge response algorithm, with a frequency of approximately 25 kHz or via blue tooth interfaces.

21. The system according to claim 8, wherein activities of the transponder or the safety device is logged and readable by a computer.

22. Method for securing a hand-held weapon, for operating a safety device according to claim 1, with the following steps:

providing a transponder which is a adapted to emit a wireless cryptified authenticating signal which authenticates at least one authorized weapon user or authenticates an allowed area for using the weapon, emitting the authenticating signal by the transponder to the safety device, receiving and processing the authenticating signal from the transponder, and unlocking the safety device and permitting firing of the weapon by the user upon receipt of an authenticating signal from the transponder authenticating an authorized user.

23. The method according to claim 22, wherein the transponder and the safety device communicate wirelessly by a bidirectional wireless signal transmission based on a Challenge response algorithm with a frequency of 25 kHz or via blue tooth interfaces.

* * * * *